US009091258B2

(12) United States Patent
Scarsdale

(10) Patent No.: US 9,091,258 B2
(45) **Date of Patent: *Jul. 28, 2015**

(54) SUBSEA PUMPING SYSTEM WITH INTERCHANGEABLE PUMPING UNITS

(71) Applicant: Kevin T. Scarsdale, Pearland, TX (US)

(72) Inventor: Kevin T. Scarsdale, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 185 days.

This patent is subject to a terminal disclaimer.

(21) Appl. No.: 13/631,900

(22) Filed: Sep. 29, 2012

(65) Prior Publication Data

US 2013/0019969 A1 Jan. 24, 2013

Related U.S. Application Data

(62) Division of application No. 12/268,108, filed on Nov. 10, 2008, now Pat. No. 8,500,419.

(51) Int. Cl.
*F04B 35/04* (2006.01)
*F04D 13/08* (2006.01)

(52) U.S. Cl.
CPC ..... *F04B 35/04* (2013.01); *F04D 13/086* (2013.01)

(58) Field of Classification Search
CPC ..... F04B 35/04; F04D 13/086
USPC ..... 417/423.3
See application file for complete search history.

(56) References Cited

U.S. PATENT DOCUMENTS

| | | | | |
|---|---|---|---|---|
| 6,640,901 | B1 | 11/2003 | Appleford et al. | |
| 7,481,270 | B2 | 1/2009 | Shepler | |
| 2005/0217857 | A1 | 10/2005 | Rodrigues et al. | |
| 2006/0118310 | A1 | 6/2006 | Euphemio et al. | |
| 2006/0162934 | A1 * | 7/2006 | Shepler | 166/370 |
| 2007/0235195 | A1 * | 10/2007 | Lawson | 166/352 |
| 2009/0032264 | A1 | 2/2009 | Shepler | |
| 2009/0178848 | A1 | 7/2009 | Nellessen, Jr. et al. | |
| 2009/0217992 | A1 * | 9/2009 | Wilson | 137/565.01 |

FOREIGN PATENT DOCUMENTS

GB 2267107 * 11/1993

* cited by examiner

*Primary Examiner* — Charles Freay
(74) *Attorney, Agent, or Firm* — Michael Stonebrook; Brandon Clark

(57) ABSTRACT

A system can include a skid, a support structure to support the skid on a sea floor, mounts connected to the skid, an electrical connector for each of the mounts to power an electric submersible pump housed by a tubular housing, fluid connectors for each of the mounts, tubular housing fluid isolation valves for each of the mounts, at least one fluid bypass that comprises a fluid bypass isolation valve, and a subsea control module for control of the tubular housing fluid isolation valves, the fluid bypass isolation valve and electricity to each of the electrical connectors. Various other devices, systems, methods, etc., are also disclosed.

18 Claims, 4 Drawing Sheets

SUBSEA PUMPING SYSTEM WITH INTERCHANGEABLE PUMPING UNITS

RELATED APPLICATIONS

This application is a divisional of co-pending U.S. patent application Ser. No. 12/268,108, filed Nov. 10, 2008, which is incorporated by reference herein.

BACKGROUND

In a variety of subsea applications, fluids are pumped from one region to another. For example, fluid can be produced upwardly from a subsea well, or fluid can be directed through subsea flowlines or injected into subsea wells. Sometimes existing pumping equipment is not adequate for a given task, and boosting pumps and equipment are added to the subsea equipment to facilitate the pumping applications. However, existing subsea pumping equipment used for boosting pumping capacity can be difficult and expensive to construct and/or use in the subsea environment.

SUMMARY

In general, the present application provides a system and methodology for pumping fluid in subsea applications, such as booster pumping applications. A self-contained pumping module is created by mounting one or more removable pumping units on a skid that can be lowered to a sea floor. Each removable pumping unit comprises an outer housing, e.g. pod, which encloses an electric submersible pumping system. The self-contained pumping module also comprises hydraulic connectors and electrical connectors that facilitate ease of connection with corresponding hydraulic lines and electric lines while at a subsea location. The self-contained nature of the pumping module enables easy deployment to a sea floor/retrieval from the sea floor, which allows the pumping module to be deployed in a variety of applications with reduced complexity and cost.

BRIEF DESCRIPTION OF THE DRAWINGS

Certain embodiments will hereafter be described with reference to the accompanying drawings, wherein like reference numerals denote like elements, and.

DETAILED DESCRIPTION

Figure 1:
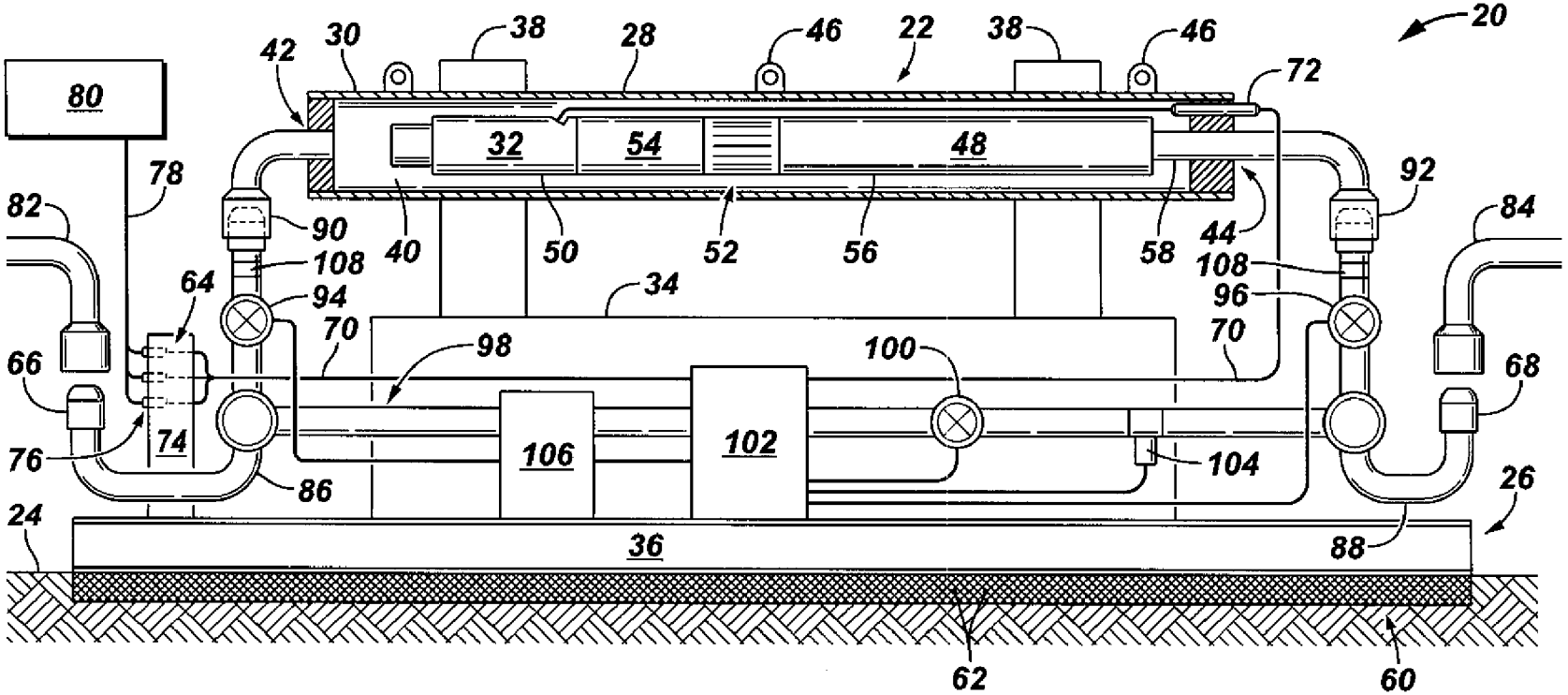
FIG. 1 is a front elevation view of one example of a self-contained pumping module, according to an embodiment.

In the following description, numerous details are set forth to provide an understanding of the present application. However, it will be understood by those of ordinary skill in the art that many embodiments may be practiced without these details and that numerous variations or modifications from the described embodiments may be possible.

The present application generally relates to a system and methodology for facilitating pumping of a fluid at a subsea location, e.g. a location proximate a subsea wellhead. The technique utilizes a self-contained pumping module that can be lowered to the sea floor and retrieved from the sea floor as a single module to provide additional pumping capacity without undue increases in time and costs. The overall system is simple in design and easy to install without any extensive site preparation. Additionally, the self-contained pumping module may have modular features that allow the pumping system to be tailored to specific application requirements.

In many applications, the self-contained pumping module is used to supplement or boost the pumping of fluids in a subsea environment without requiring major site preparation. The pumping module simply is lowered to the sea floor where hydraulic and electrical connections are easily made by, for example, use of a remotely operated vehicle. In many applications, the pumping module is positioned directly onto the sea floor. Because of the simple, self-contained design, positioning of the pumping module on the sea floor can be accomplished via a crane mounted on a work boat instead of requiring a work-over rig, semi-submersible platform, or drilling rig.

By way of example, the self-contained pumping module can be used in boosting fluids from subsea wells when it is not practical, feasible or desirable to install large horsepower electric submersible pumping systems or other artificial lift systems into a subsea wellbore to produce a fluid to a surface location. The self-contained pumping module can be lowered to the sea floor near a wellhead, for example, to provide boosting to a surface platform, subsea processing facility, floating production, storage and offloading vessel, or other surface locations. In some applications, the pumping module can be placed downstream of subsea processing facilities to provide lift required to produce the fluid to the surface.

Apart from production applications, the self-contained pumping module also can be positioned at the sea floor and used to inject fluid into subsea wells. For example, the pumping module can be used to inject water to facilitate pressure maintenance of a reservoir. In this type of application, the pumping module can be connected to a suitable source of water, such as drilled water source wells, subsea processing facilities, surface processing facilities, or the surrounding ocean. In other applications, the self-contained pumping module can be used in the commissioning of subsea pipelines by removing the water used to sink and hydrostatically test the subsea pipelines. In many of these types of applications, the pumping module can be used to discharge the water directly into the ocean or to deliver the water to appropriate surface or subsea facilities.

Referring generally to FIG. 1, a pumping system 20 is illustrated according to one embodiment. In this embodiment, pumping system 20 comprises a self-contained pumping module 22 that can be lowered to and retrieved from a sea floor 24. The self-contained pumping module 22 may be constructed in a variety of configurations with a variety of components, and several examples are described below.

In the embodiment illustrated in FIG. 1, the self-contained pumping module 22 comprises a skid 26 on which a pumping unit 28 is removably mounted. The pumping unit 28 comprises an outer housing 30, e.g. a pod, which encloses an electric submersible pumping system 32. As illustrated, the outer housing 30 and the electric submersible pumping system 32 are constructed and positioned in a generally horizontal orientation. However, pumping unit 28 may be mounted on skid 26 in a variety of orientations and with a variety of other mechanisms. The self-contained pumping module embodiment illustrated in FIG. 1 uses a substructure or platform 34 by which the pumping unit is mounted to a base portion 36 of skid 26. By way of example, pumping unit 28 may be mounted to substructure 32 via appropriate brackets 38, such as clamps or cradles that enable the interchanging of pumping units. The brackets 38 may comprise cradles with latch mechanisms or clamps that are selectively clamped onto outer housing 30 under actuation via remotely operated vehicle, hydraulic input, electrical input, or other appropriate input depending on the design of the clamps. A given pumping unit 28 can be replaced to address wear issues, performance issues, or other issues related to the pumping of fluid at a subsea location. The replacement or other interchange of pumping units may be accomplished while the self-contained pumping module 22 is positioned at the subsea location.

Outer housing 30 may be tubular in design, such as a pipe, and sized to have an interior 40 that allows fluid, e.g. oil, to surround/submerge the electric submersible pumping system 32. The outer housing 30 comprises a fluid inlet 42, through which fluid to be pumped enters interior 40, and a fluid discharge 44 through which pumped fluid exits outer housing 30. In the embodiment illustrated, fluid inlet 42 and fluid discharge 44 are positioned on opposite ends of outer housing 30. Outer housing 30 also may comprise one or more lifting brackets 46 by which cables or other lifting mechanisms can be attached to remove and/or install pumping unit 28 during interchanging of pumping units.

Electric submersible pumping system 32 is selected to fit within and operate within interior 40. The electric submersible pumping system 32 may have a variety of configurations and incorporate various components depending on the environment, application and fluid to be pumped. By way of example, electric submersible pumping system 32 comprises a pump 48, such as a centrifugal pump. A submersible motor 50, such as a three-phase motor, is operatively connected to pump 48. Submersible motor 50 is designed to enable operation in a horizontal orientation. During operation of pump 48, fluid is drawn from the interior 40 into electric submersible pumping system 32 through a pump intake 52. A motor protector 54 may be positioned between submersible motor 50 and pump 48 to isolate dielectric oil inside motor 50 from the pumped fluid and to carry the hydraulic thrust of pump 48. The electric submersible pumping system 32 also may incorporate a variety of other components, such as a gas handling device 56 that may be an independent component or combined with intake 52. Examples of gas handling devices 56 include rotary gas separators and gas compression devices. As illustrated, electric submersible pumping system 32 may be connected to the fluid discharge end 44 of outer housing 30 via a discharge pipe 58 that extends from a discharge end of pump 48 to discharge outlet 44. The diameter and length of pump 48, as well as the size and power of motor 50, can be selected according to the desired flow rate and differential pressure for a given subsea application.

The various components of self-contained pumping module 22 are designed to work in a subsea environment. For example, skid 26 may be constructed from structural steel welded or otherwise fastened together to provide a rigid base. The structural steel or other suitable component also can be painted or otherwise coated to prevent corrosion during operation in the subsea environment. Additionally, skid 26 may comprise a lower support structure 60 to secure the self-contained pumping module 22 on the sea floor. For example, support structure 60 may comprise a material or structure designed to secure the self-contained pumping module 22 in a typical seafloor constituent, such as mud or sand. In one embodiment, support structure 60 comprises a mesh material 62 constructed as a "mud mat" that securely positions pumping module 22 at a desired location in the mud/sand of the sea floor.

The self-contained pumping module 22 also comprises a plurality of connectors, including electrical connectors 64 and hydraulic connectors 66 and 68. In many applications, electrical connectors 64 are wet mate connectors that enable easy connection with corresponding electric cable via, for example, a remotely operated vehicle. In the specific example illustrated, electric cable or other types of electric lines 70 are used to connect motor 50 with electrical connectors 64. The electric lines 70 extend from electrical connectors 64 to a penetrator 72 that penetrates through outer housing 30 to interior 40. Electric lines 70 continue along the interior 40 and may be connected to submersible motor 50 with a conventional submersible motor connection.

In one embodiment, the electrical connectors 64 are wet mate connectors mounted in a structure 74, such as a stab plate secured to skid 26. The stab plate may be mounted at various locations along the edge of the skid 26 or at other suitable locations that enable easy connection with a subsea power grid or other source of power. Electrical power is supplied to electrical connectors 64 in structure 74, e.g. female wet mate connectors, via corresponding wet mate connectors 76, e.g. male wet mate connectors, carried on electric supply cables 78. The electric power may be supplied via a subsea power grid and controlled by a control system 80 which can be located top side, on a floating production, storage and offloading vessel, on a production platform, or at a subsea location. The control system 80 can be designed to control any of the various embodiments of self-contained pumping module 22.

Similarly, hydraulic connectors 66, 68 may be formed as hydraulic wet mate connectors that enable easy connection of hydraulic lines 82, 84 via, for example, a remotely operated vehicle. The hydraulic inlet connector 66 may be connected to piping, e.g. hydraulic line 82, that extends directly from a subsea wellhead, a subsea processing facility, a subsea pipeline, or another subsea structure carrying fluid for which boosted fluid flow or other flow is desired.

In the embodiment illustrated, hydraulic connector 66 is coupled with fluid inlet 42 of outer housing 30 via a flow tubing 86; and hydraulic connector 68 is coupled with fluid discharge 44 of outer housing 30 via a flow tubing 88. Additional features also may be provided along flow tubing 86 and flow tubing 88. For example, hydraulic wet mate connectors 90, 92 may be connected along flow tubing 86, 88, respectively. The hydraulic wet mate connectors 90, 92 enable easy engagement and disengagement of pumping unit 28 from the self-contained pumping module 22 during, for example, interchanging of pumping units. Isolation valves 94, 96 also may be deployed along flow tubings 86, 88, respectively, to enable flow shutoff during removal of pumping unit 28. The isolation valves 94, 96 are actuated to an open or flow position when pumping unit 28 is engaged with self-contained pumping module 22.

The self-contained pumping module 22 also may comprise a bypass 98 to allow fluid flow to continue when pumping units 28 are removed, e.g. replaced. In some applications, gas lift can be used in cooperation with the bypass 98 to provide moderate boosting during a change out cycle. The bypass 98 also may comprise an isolation valve 100 to allow flow in a bypass mode and to block flow during operation of pumping unit 28.

The actuation of isolation valve 100, as well as the actuation of isolation valves 94, 96, can be controlled via a control system 80. However, the isolation valves also can be controlled in whole or in part by a subsea control module 102 mounted on skid 26. The subsea control module 102 (and/or control system 80) can further be used to control other components or to receive data from other components. For example, control module 102 may be coupled with a sensor 104 mounted in bypass 98 and a source selector switch 106 mounted on skid 26.

In a variety of applications, additional instrumentation 108 can be added to self-contained pumping module 22 to monitor other parameters related to the pumping operation. For example, the instrumentation 108 may comprise sensors, such as temperature sensors, pressure sensors, flow rate sensors and other sensors. The instrumentation also may include other types of components used to provide feedback and/or to control specific functions, such as the opening and closing valves. Instrumentation 108 can be operatively connected with subsea control module 102 and/or control system 80.

Figure 2:
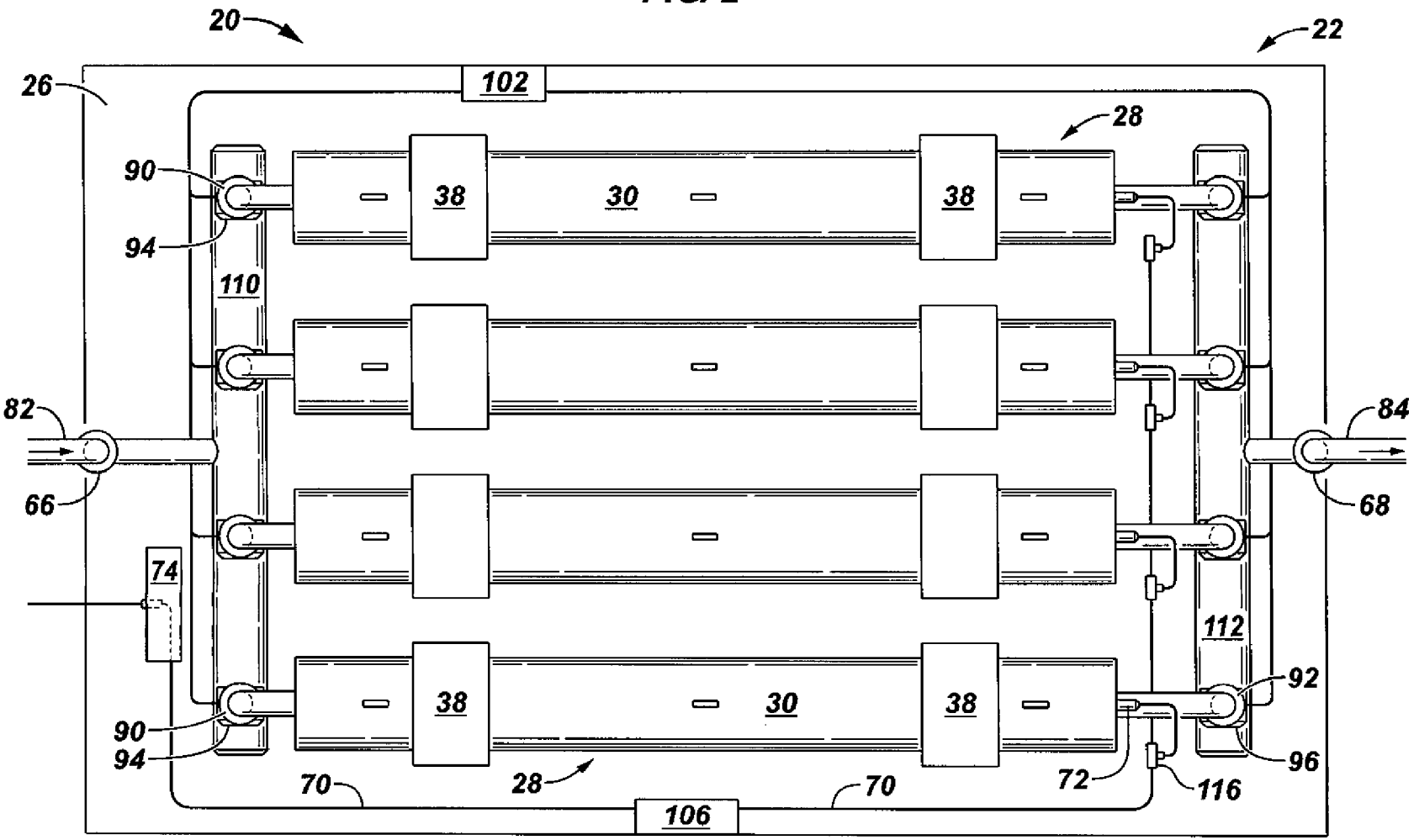
FIG. 2 is a top view of another example of the self-contained pumping module illustrated in FIG. 1, according to an alternate embodiment.

Referring generally to FIG. 2, another embodiment of self-contained pumping module 22 is illustrated. In this embodiment, the pumping module 22 comprises a plurality of pumping units 28 mounted on a single skid 26 to provide flexibility and/or redundant systems. In the embodiment of FIG. 2, for example, the series of pumping units 28 comprise four individual pumping units mounted in parallel, and each unit comprises outer housing 30 and internal electric submersible pumping system 32. During operation of pumping units 28, fluid is drawn in through the hydraulic line 82 coupled to hydraulic connector 66. The supplied fluid flows through hydraulic connector 66 and into an intake manifold 110 that supplies the individual intake flow tubes 86 for the plurality of pumping units 28. Once the fluid is pumped by the electric submersible pumping systems 32 and discharged through the fluid discharge 44 of each pumping unit 28, the fluid flows into a discharge manifold 112, out through hydraulic connector 68, and subsequently through hydraulic line 84.

The motors 50 of the electric submersible pumping systems 32 can be supplied with electrical power via electric lines 70 which may be in the form of electric cables connected to structure 74. The flow of electrical power to specific, individual electric submersible pumping systems 32 may be controlled by an appropriate switching system, such as source selector switch 106. In some applications, the flow of electrical power can be directed through individual connectors 116 which can be selectively connected and disconnected by, for example, a remotely operated vehicle. Depending on the specific configuration of self-contained pumping module 22, subsea control module 102 and/or control system 80 can be used to control selector switch 106 and the flow of electricity to each electric submersible pumping system as well as the flow of data to and from instrumentation incorporated into self-contained pumping module 22. The control module/system also can be used to control isolation valves, other valves, and other components that may be subjected to a controlled actuation.

Figure 3:
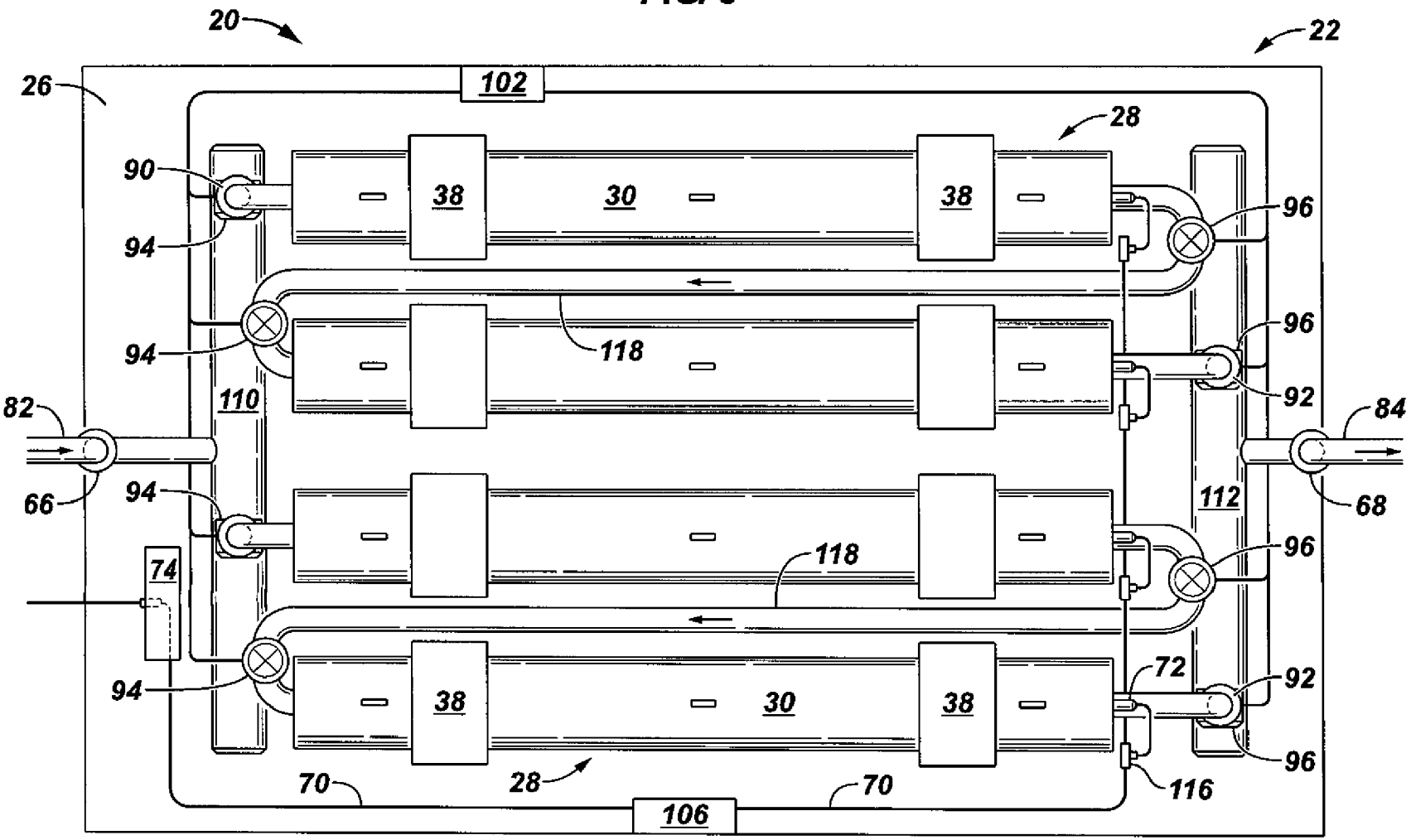
FIG. 3 is a top view of another example of the self-contained pumping module illustrated in FIG. 1, according to an alternate embodiment.

Another embodiment of self-contained pumping module 22 is illustrated in FIG. 3. In this embodiment, a plurality of pumping units 28 is again arranged on the single skid 26. In the particular example illustrated, four pumping units 28 are mounted on skid 26 with pairs of the pumping units 28 connected in series via tubes 118 to provide twice the boost pressure of a single pumping unit. The two pairs of pumping units 28 are then operated in parallel, via connections to intake manifold 110 and discharge manifold 112, to provide twice the flow rate relative to a single pair of the pumping units 28 connected in series. It should be noted that in this embodiment and the other embodiments described herein, the number of pumping units 28 mounted on the single skid 26 can vary according to the requirements of a specific application. Additionally, one pair of pumping units can be used as a redundant or backup pair.

Figure 4:
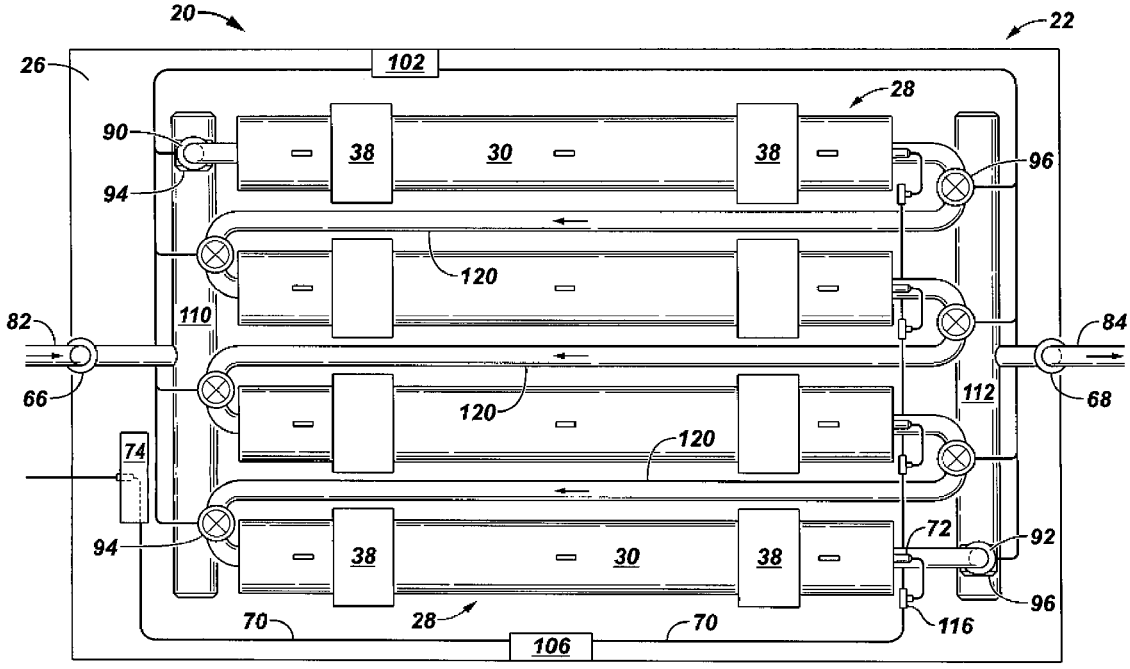
FIG. 4 is a top view of another example of the self-contained pumping module illustrated in FIG. 1, according to an alternate embodiment.

Referring generally to FIG. 4, another embodiment of self-contained pumping module 22 is illustrated. In this embodiment, a plurality of pumping units 28 is mounted on skid 26 in a generally horizontal orientation and connected in series via tubes 120. In the specific example illustrated, four pumping units 28 are connected in series, although the number of pumping units can be varied according to the requirements of a given application. The four pumping units connected in series provide four times the discharge pressure at a given flow rate.

The size, configuration, and component types used to construct self-contained pumping module 22 can be varied to accommodate many types of subsea pumping applications, including production fluid boosting applications and injection applications. An individual pumping unit can be mounted on the skid, or a plurality of pumping units can be mounted on the skid in many configurations, including parallel configurations, serial configurations, and numerous combinations of parallel and serial configurations. Additionally, the materials and structure of skid 26 and support structure 60 can be selected to accommodate easy positioning of the self-contained pumping module 22 directly onto seafloor 24. The skid 26 can be deployed to many types of locations for use in a variety of subsea pumping applications, including the boosting of fluid flow from subsea wells. Similarly, the position and configuration of the wet mate connectors, both hydraulic and electrical, can vary from one application to another to accommodate easy connection of electric lines and hydraulic lines.

Although only a few embodiments have been described in detail above, those of ordinary skill in the art will readily appreciate that many modifications are possible without materially departing from the teachings of this application. Such modifications are intended to be included within the scope defined in the claims.

What is claimed is:

1. A system comprising:

a skid;

a mesh support structure to support the skid on a sea floor;

mounts connected to the skid, each mount configured to releasably mount a tubular housing to the skid;

an electrical connector for each of the mounts to power an electric submersible pump housed by a tubular housing;

fluid connectors for each of the mounts;

tubular housing fluid isolation valves for each of the mounts;

at least one fluid bypass that comprises a fluid bypass isolation valve; and a subsea control module for control of the tubular housing fluid isolation valves, the fluid bypass isolation valve and electricity to each of the electrical connectors.

2. The system of claim 1 comprising a bypass mode for the fluid bypass isolation valve in an open state and a block mode for the fluid bypass isolation valve in a closed state.

3. The system of claim 1 comprising a source selector switch controllable by the subsea control module to control electrical power to specific, individual electric connectors.

4. The system of claim 1 comprising a series configuration for flow through tubular housing fluid isolation valves for at least two mounts in series and a parallel configuration for flow through tubular housing fluid isolation valves for at least two mounts in parallel.

5. The system of claim 1 comprising a tubular housing mounted to one of the mounts.

6. The system of claim 5 comprising an electric submersible pump encased in the tubular housing.

7. The system of claim 6, wherein the electric submersible pump comprises a centrifugal pump, a motor powering the centrifugal pump, and a motor protector positioned between the centrifugal pump and the motor.

8. The system of claim 1, wherein each of the electrical connectors comprises a wet mate electrical connector.

9. The system of claim 1, wherein each of the fluid connectors comprises a wet mate fluid connector.

10. The system of claim 1 comprising a bypass sensor operatively coupled to the subsea control module.

11. The system of claim 1 comprising sensors operatively coupled to the subsea control module.

12. The system of claim 11 wherein the sensors comprise at least one member selected from a group consisting of temperature sensors, pressure sensors, and flow rate sensors.

13. The system of claim 1 comprising an intake manifold that comprises fluid connectors, one for each of the mounts.

14. The system of claim 13 wherein the tubular housing fluid isolation valves for each of the mounts comprises an intake tubular housing fluid isolation valve disposed downstream of the intake manifold.

15. The system of claim 1 comprising a discharge manifold that comprises fluid connectors, one for each of the mounts.

16. The system of claim 15 wherein the tubular housing fluid isolation valves for each of the mounts comprises a discharge tubular housing fluid isolation valve disposed upstream the discharge manifold.

17. The system of claim 1 comprising an intake manifold and a discharge manifold wherein the tubular housing fluid isolation valves comprise an intake side tubular housing fluid isolation valves for each of the mounts disposed downstream of the intake manifold and a discharge side tubular housing fluid isolation valve for each of the mounts disposed upstream the discharge manifold.

18. A system, comprising:

a skid;

a mesh support structure to support the skid on a sea floor;

a plurality of horizontal electric submersible pumping systems;

a plurality of tubular housings releasably mounted to the skid, each tubular housing enclosing a corresponding one of the electric submersible pumping systems and comprising an inlet with a controllable inlet valve and an outlet with a controllable outlet valve;

a plurality of electrical connectors to power the electric submersible pumping systems;

at least one fluid bypass that comprises a fluid bypass isolation valve; and a subsea control module for control of the inlet valves, the outlet valves and the fluid bypass isolation valve and electricity to each of the electrical connectors.

* * * * *